US009518799B2

(12) United States Patent
Stevens

(10) Patent No.: US 9,518,799 B2
(45) Date of Patent: Dec. 13, 2016

(54) PAINTBALL MARKER WITH SECURE BARREL ENGAGEMENT

(71) Applicant: KEE Action Sports I LLC, Sewell, NJ (US)

(72) Inventor: Simon B. Stevens, Sewell, NJ (US)

(73) Assignee: GI Sportz Direct LLC, Sewell, NJ (US)

( * ) Notice: Subject to any disclaimer, the term of this patent is extended or adjusted under 35 U.S.C. 154(b) by 0 days.

(21) Appl. No.: 14/617,274

(22) Filed: Feb. 9, 2015

(65) Prior Publication Data

US 2015/0153134 A1 Jun. 4, 2015

Related U.S. Application Data

(63) Continuation of application No. 13/835,231, filed on Mar. 15, 2013, now Pat. No. 8,950,387.

(60) Provisional application No. 61/756,813, filed on Jan. 25, 2013.

(51) Int. Cl.
*F41B 11/72* (2013.01)
*F41B 11/70* (2013.01)

(52) U.S. Cl.
CPC ..... *F41B 11/70* (2013.01)

(58) Field of Classification Search
CPC ..... F41B 11/62; F41B 11/72; F41A 3/58; F41A 3/66; F41C 7/11
USPC ..... 124/73, 56
See application file for complete search history.

(56) References Cited

U.S. PATENT DOCUMENTS

| | | | |
|---|---|---|---|
| 36,571 | A | 9/1862 | Moses |
| 572,290 | A | 12/1896 | Clement |
| 1,183,644 | A | 5/1916 | Hill |
| 1,545,465 | A | 7/1925 | Johnstone et al. |
| 2,150,288 | A | 2/1937 | Moller |
| 3,153,874 | A | 10/1964 | Merrill |
| 3,229,400 | A | 1/1966 | Del Pozo, Jr. |
| 3,233,601 | A | 2/1966 | Walther |
| 3,318,192 | A | 5/1967 | Miller et al. |
| 3,379,188 | A | 4/1968 | Walther |
| 3,561,149 | A | 2/1971 | Center |
| 3,791,256 | A | 2/1974 | Curtis et al. |
| 3,913,553 | A | 10/1975 | Braughler et al. |
| 3,996,684 | A | 12/1976 | Bauman et al. |
| 3,996,685 | A | 12/1976 | Bauman et al. |
| 4,044,487 | A | 8/1977 | Hutton et al. |
| 4,299,046 | A | 11/1981 | Atchisson |
| 4,541,192 | A | 9/1985 | Flodman et al. |

(Continued)

FOREIGN PATENT DOCUMENTS

| | | |
|---|---|---|
| GB | 2 056 635 A | 3/1981 |
| WO | 02 42708 A1 | 5/2002 |

OTHER PUBLICATIONS

FT-12 Owner's Manual, Ver. 05/12, Manufactured by Tippman (24 pages).

*Primary Examiner* — Michael David

(74) *Attorney, Agent, or Firm* — Volpe and Koenig, P.C.

(57) ABSTRACT

A paintball gun generally comprising a body split into an upper portion and a lower portion is provided. The split body allows exposure of internal components for access, service and/or maintenance. In an embodiment, the paintball gun preferably includes a valve assembly fixedly secured within the body. In an embodiment, the paintball gun preferably includes a barrel adapter for engaging a barrel, with the barrel adapter secured within the body by a gripping piece. A method of servicing a paintball gun is also provided.

12 Claims, 14 Drawing Sheets

(56) References Cited

U.S. PATENT DOCUMENTS

| | | | | |
|---|---|---|---|---|
| 4,660,311 | A | 4/1987 | Breitfeld et al. | |
| 4,757,627 | A | 7/1988 | Saligari | |
| 4,774,929 | A | 10/1988 | Milliman | |
| 4,999,939 | A | 3/1991 | Reese et al. | |
| 5,062,231 | A | 11/1991 | Braverman et al. | |
| 5,160,795 | A | 11/1992 | Milliman | |
| 5,165,383 | A | 11/1992 | Ebert et al. | |
| 5,225,610 | A | 7/1993 | Uria | |
| 5,335,581 | A | 8/1994 | Simon et al. | |
| 5,404,863 | A | 4/1995 | Poor | |
| 5,529,050 | A | 6/1996 | D'Andrade | |
| 5,610,362 | A | 3/1997 | Bouvard | |
| 5,622,160 | A | 4/1997 | Casa Salva | |
| 5,711,286 | A | 1/1998 | Petrosyan et al. | |
| 5,884,615 | A | 3/1999 | Casas Salva | |
| 6,119,671 | A | 9/2000 | Smith et al. | |
| 6,539,659 | B2 | 4/2003 | Casa Salva | |
| 6,578,565 | B2 | 6/2003 | Casas Salva | |
| 6,637,310 | B2 | 10/2003 | Borgwarth | |
| 6,705,035 | B2 | 3/2004 | Gussalli Beretta | |
| 6,766,795 | B1 | 7/2004 | Sullivan | |
| 6,907,687 | B2 | 6/2005 | Rousseau et al. | |
| 7,207,130 | B2 | 4/2007 | Rousseau et al. | |
| 7,690,373 | B2 | 4/2010 | Telford et al. | |
| 7,814,695 | B1 | 10/2010 | Keeney et al. | |
| 7,900,622 | B2 | 3/2011 | Douglas et al. | |
| 7,941,954 | B2 | 5/2011 | Carr et al. | |
| 8,118,017 | B2 | 2/2012 | Lammonds | |
| 8,333,181 | B1 | 12/2012 | Rice | |
| 8,683,990 | B2 | 4/2014 | Macy | |
| 8,839,542 | B2 | 9/2014 | Dubois et al. | |
| 2008/0295818 | A1 | 12/2008 | Styles et al. | |
| 2009/0025701 | A1* | 1/2009 | Douglas | F41B 11/57 124/77 |
| 2009/0120420 | A1 | 5/2009 | Tippmann, Jr. et al. | |
| 2009/0194088 | A1 | 8/2009 | Tippman, Jr. et al. | |
| 2009/0277066 | A1 | 11/2009 | Burt et al. | |
| 2014/0060510 | A1* | 3/2014 | Macy | F41B 11/70 124/73 |
| 2014/0144418 | A1 | 5/2014 | Macy | |
| 2014/0209082 | A1* | 7/2014 | Stevens | F41B 11/70 124/73 |

* cited by examiner

PAINTBALL MARKER WITH SECURE BARREL ENGAGEMENT

CROSS REFERENCE TO RELATED APPLICATION

This application is a continuation of U.S. patent application Ser. No. 13/835,231, filed Mar. 15, 2013, issuing as U.S. Pat. No. 8,950,387 on Feb. 10, 2015, which claims the benefit of U.S. Provisional Patent Application No. 61/756,813, filed Jan. 25, 2013, the entire contents of all of which are hereby incorporated by reference as if fully set forth herein.

FIELD OF INVENTION

This invention relates to the field of paintball markers, and more particularly, to a paintball gun with a split body.

BACKGROUND

Paintball, a popular sport that has developed over the years, which uses compressed gas guns (paintball markers or paintball guns), which utilize compressed gas to fire projectiles. Some examples of paintball guns are those offered under the brand names EMPIRE™, BT™, and MINI™, and others shown and described in U.S. Pat. Nos. 6,708,685; 4,936,282; 5,497,758; and U.S. patent application Ser. Nos. 11/183,548; 11/180,506; 11/150,002; 11/064,693; 10/313,465; 10/090,810, the entire contents of all of which are hereby incorporated by reference as if fully set forth herein. Players use the paintball guns to shoot projectiles known as paintballs (projectiles and paintballs may be used interchangeably herein). These paintballs are spherical, frangible projectiles normally having gelatin shells that may rupture on impact filled with paint (coloring or dye). The shells break when impacting a target, allowing the paint within to splatter on a target. A player is eliminated from a game when the player is hit by a paintball fired from an opposing player's paintball gun. When the paintball hits a target such as a player, a mark or "splat" of paint is left on the player.

Paintball guns generally have two basic mechanisms working in conjunction for firing a paintball from the marker during a firing operation. One of these mechanisms is for loading a paintball in the breech of a paintball marker, and usually involves a bolt that reciprocates from a loading position, allowing a projectile into the breech, to a firing position. A valving system is employed to release compressed gas from a source of compressed gas to fire the projectile from the marker.

Referring to FIG. 1, an exemplary prior art paintball gun 130 is illustrated having a gun body 132 with a rearward end 134 towards its grip 136 and a forward end 138 towards its barrel 140 is shown. The gun body 132 includes a generally cylindrical interior passage or space (a portion of which may be considered a breech area) for receiving at least some of the firing components (e.g., the hammer and valving components) of the gun 130. A hammer 144 (sometimes referred to in the art as a ram, striker or bolt) is disposed within the gun body 132 adjacent the rearward end 134 of the gun body 132, the hammer 144 having a forward end 146 facing the valve 160. The forward end 146 of the hammer 144 is adapted to contact a valve pin 148.

A main hammer spring 150 is disposed within the gun body 132 and biases the hammer 144 toward the forward or firing position. The hammer 144 is retained in a cocked or ready position by a sear 152 that pivots to engage a portion of the hammer 144. Actuation of a trigger 154 (such as by pulling the trigger) disengages the sear 152 from the hammer 144, allowing the hammer 144 to spring forward under the bias of the main hammer spring 150.

A bolt 156 is disposed within the gun body 132. A firing tube 158 is partially disposed within the bolt 156, such that the bolt 156 coaxially surrounds the firing tube 158. A lateral screw 194 for adjusting the velocity of gas within the firing tube 158 protrudes as shown. Forward movement of the bolt 156 causes forward movement and loading of a projectile 142.

A valve 160 is disposed within the gun body 132 between the hammer 144 and the bolt 156. The valve 160 includes a valve pin 148 extending rearward toward the hammer 144, the valve pin 148 including a contact end 162. A connecting rod 64 connects the hammer 44 and the bolt 56 for synchronized movement of the hammer 44 and the bolt 56. A connecting rod 164 provides a mechanical linkage between the hammer 144 and the bolt 156. The valve 160 assembly includes a valve housing 166 and a valve body 168 disposed within the valve housing 166. The valve body 168 includes an inlet port 170 for receiving gas under pressure from a gas line 196. The valve body 168 includes an outlet port 176 for communicating gas under pressure from within the valve body 168 when the valve 160 is actuated or open. A valve poppet 184 is disposed within the valve body 168. A sealing member such as a cup seal 186 is provided to the valve poppet 184.

A problem with prior art paintball guns is that it is not always easy to gain access to the interior. For example, the body of the paintball gun is usually held together by various screws, bolts and pins, making it difficult to gain access to the interior contents to check or service the paintball gun. If a paintball ruptures inside the paintball gun, a player must gain access to the components to clean and/or otherwise service the paintball gun.

In addition, paintball sport players, as well as those who may service a paintball gun (collectively, any person who may maintain, service, access the interior of, clean or adjust a paintball gun referred to as a "user"), may want to field strip a paintball gun; that is, a user may wish to disassemble a paintball gun for cleaning, service, maintenance, adjustment and/or inspection. During a break from game play, a paintball sport player might wish to take their paintball gun apart to adjust or otherwise service it.

In order to field strip a paintball gun, many such known guns require the removal of numerous parts, and/or the process is difficult, inefficient and/or time consuming. For example, the bodies of many prior art paintball guns were formed as solid and/or one-piece units, having only an opening at one end. This provides a very limited access to the internal components such as the firing assembly of the paintball gun. Of course, the paintball gun then has to be put back together for use, and that too, may be time consuming in connection with prior art designs.

Accordingly, there is the need for a paintball gun having a body that provides efficient, simple and/or easy access to the interior contents.

SUMMARY

The present invention is directed to a paintball gun comprising a body with a forward end and a rearward end. The body is split substantially along a central longitudinal axis into an upper portion and a lower portion. The upper portion is preferably attached to the lower portion by a hinge positioned preferably adjacent to the forward end of the body with the upper portion and the lower portion of the body moveable relative to each other via the hinge. Movement of the upper portion relative to the lower portion exposes a firing mechanism of the paintball gun for maintenance.

In another embodiment, the present invention is directed to a paintball gun comprising a body with a forward end and a rearward end. The body is split substantially along a central longitudinal axis into an upper portion and a lower portion. The upper portion is preferably attached to the lower portion by a hinge positioned adjacent to the forward end of the body and the upper portion and the lower portion are moveable relative to each other via the hinge. A valve assembly is preferably secured to the lower portion and is configured to remain secured to the lower portion when the upper portion and lower portion are moved away from each other.

In another embodiment, the present invention is directed to a paintball gun comprising a barrel, a barrel adapter attached to the barrel, and a body having a forward end and a rearward end. The body is preferably split substantially along a central longitudinal axis into an upper portion and a lower portion. The upper portion is preferably attached to the lower portion by a hinge positioned adjacent the forward end of the body, the upper portion and lower portion moveable relative to each other via the hinge. A recess is positioned on the inner surface of one of the lower portion or the upper portion adjacent the forward end of the paintball gun. A barrel gripping piece configured to mate with the recess is configured to hold the barrel adaptor in place between the upper portion and the lower portion during operation.

In another embodiment, the present invention is directed to a paintball gun comprising a barrel having a bore dimensioned to receive a frangible projectile, a body including a plurality of walls defining an interior cavity with a breech area, a valve assembly configured to selectively allow flow between a supply of compressed gas and the breech area to propel the frangible projectile through the barrel, a front bolt moveable between a first position and a second position, a rear bolt connected to the front bolt with a linkage arm and movable between a cocked position and a firing position, a drive spring configured to urge the rear bolt toward the firing position, and a firing mechanism configured to selectively release the rear bolt in response to actuation of a trigger. The front bolt is configured to push the frangible projectile towards the barrel as the front bolt moves from the first position to the second position. The rear bolt is configured to actuate the valve assembly when the rear bolt moves from the cocked position to the firing position. At least one wall of the body is movable with respect to one or more other walls of the body between an open position that opens the interior cavity to expose a top portion of the front bolt and a top portion of the rear bolt for servicing the gun and a closed position that blocks access to the interior cavity.

In another embodiment, the present invention is directed to a paintball gun comprising a barrel dimensioned to receive a frangible projectile, a body having a rearward end defining a grip and a forward end, wherein the barrel extends from the forward end of the body, a breech area defined by the body dimensioned to receive a frangible projectile for firing, a valve assembly disposed in the body and operative to selectively allow flow between a supply of compressed gas and the breech area to propel frangible projectiles through the barrel, and a firing mechanism configured to actuate the valve assembly in response to actuation of a trigger. A wall of the body is movable between an open position that allows access to internal components and a closed position.

In another embodiment, the present invention is directed to a paintball gun comprising a barrel having a bore dimensioned to receive a frangible projectile, a body defining an interior cavity with a breech area, wherein the body includes a body shell top portion, a valve assembly configured to selectively allow a flow between a supply of compressed gas and the breech area to propel the frangible projectile through the barrel, a front bolt movable between a first position and a second position, a rear bolt connected to the front bolt with a linkage arm and movable between a cocked position and a firing position, a drive spring configured to urge the rear bolt toward the firing position, and a firing mechanism configured to selectively release the rear bolt in response to actuation of the trigger. The front bolt is configured to push the frangible projectile towards the barrel as the front bolt moves from the first position to the second position. The rear bolt is configured to actuate the valve assembly when the rear bolt moves from the cocked position to the firing position. The body shell top is configured to pivot between an open position that provides access to a top portion of the front bolt and a top portion of the rear bolt and a closed position that blocks access to the top portion of the front bolt and the top portion of the rear bolt.

In another embodiment, the present invention is directed to a paintball gun comprising a barrel having a bore dimensioned to receive a frangible projectile, a body including a plurality of walls defining an interior cavity with a breech area, a valve assembly configured to selectively allow flow between a supply of compressed gas and the breech area to propel the frangible projectile through the barrel, a front bolt movable between a first position and a second position, a rear bolt connected to the front bolt with a linkage arm and movable between a cocked position and a firing position, a drive spring configured to urge the rear bolt toward the firing position, and a firing mechanism configured to selectively release the rear bolt in response to actuation of a trigger. The front bolt is configured to push the frangible projectile towards the barrel as the front bolt moves from the first position to the second position. The rear bolt is configured to actuate the valve assembly when the rear bolt moves from the cocked position to the firing position. At least one wall of the body is movable with respect to one or more other walls of the body between an open position that opens the interior cavity to expose a top portion of the front bolt and a top portion of the rear bolt for servicing the gun and a closed position that blocks access to the interior cavity.

In another embodiment, the present invention is directed to a body for a paintball gun. The body comprises a plurality of walls defining an interior cavity with a breech area and the plurality of walls includes a body shell top pivotally connected to the at least one other wall. The body also comprises a feed neck extending from the body shell top and defining an inlet into the breech area of the interior cavity and the body shell top is configured to move between an open position that provides access to the breech area and a closed position that blocks access to the breech area. The body shell top longitudinally divides the body in an open position along plane that intersects with the breech area.

In another embodiment, the present invention is directed to a method of servicing a paintball gun. The method includes the steps of providing a paintball gun with a split body having an upper portion movable between an open position that provides access to at least portions of at least some of the internal components of the paintball gun and a closed position that blocks access to at least portions of at least some of the internal components with the body in a closed position, and moving the upper and/or lower portions to an open position.

DETAILED DESCRIPTION OF THE PREFERRED EMBODIMENTS

Figure 2:
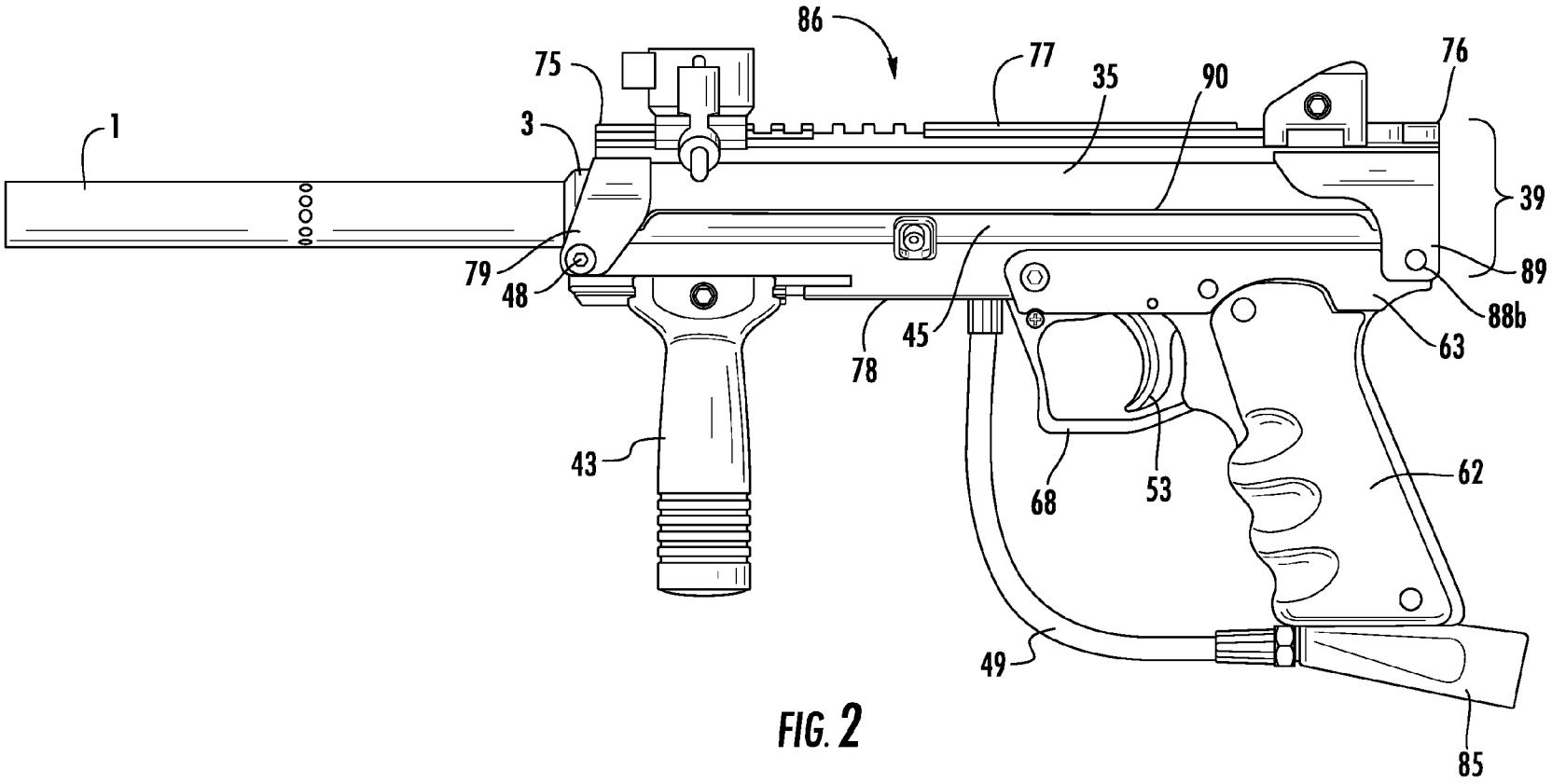
FIG. 2 shows a paintball gun according to an embodiment of showing external components of the paintball gun, from the left side, with the barrel facing left.

FIG. 2 shows the left side of an embodiment of a paintball gun according to the invention (with the barrel 1 facing left) showing the outside and external components of the paintball gun. The paintball gun illustrated in FIG. 2 includes a body 39 with a forward end 75 and a rearward end 76, a barrel 1, and a barrel adaptor 3 for receiving an end of the barrel. The paintball gun further includes an upper portion 77 (corresponding to a body shell top 35, which also may be referred to as an upper or top wall, and which also may be characterized as a "body shell top portion") and a lower portion 78 (corresponding to a body shell bottom 45, which also may be referred to as a lower or bottom wall, and which also may be characterized as a "body shell bottom portion") defining an interior area 197 and including a breech area 198.

Figure 1:
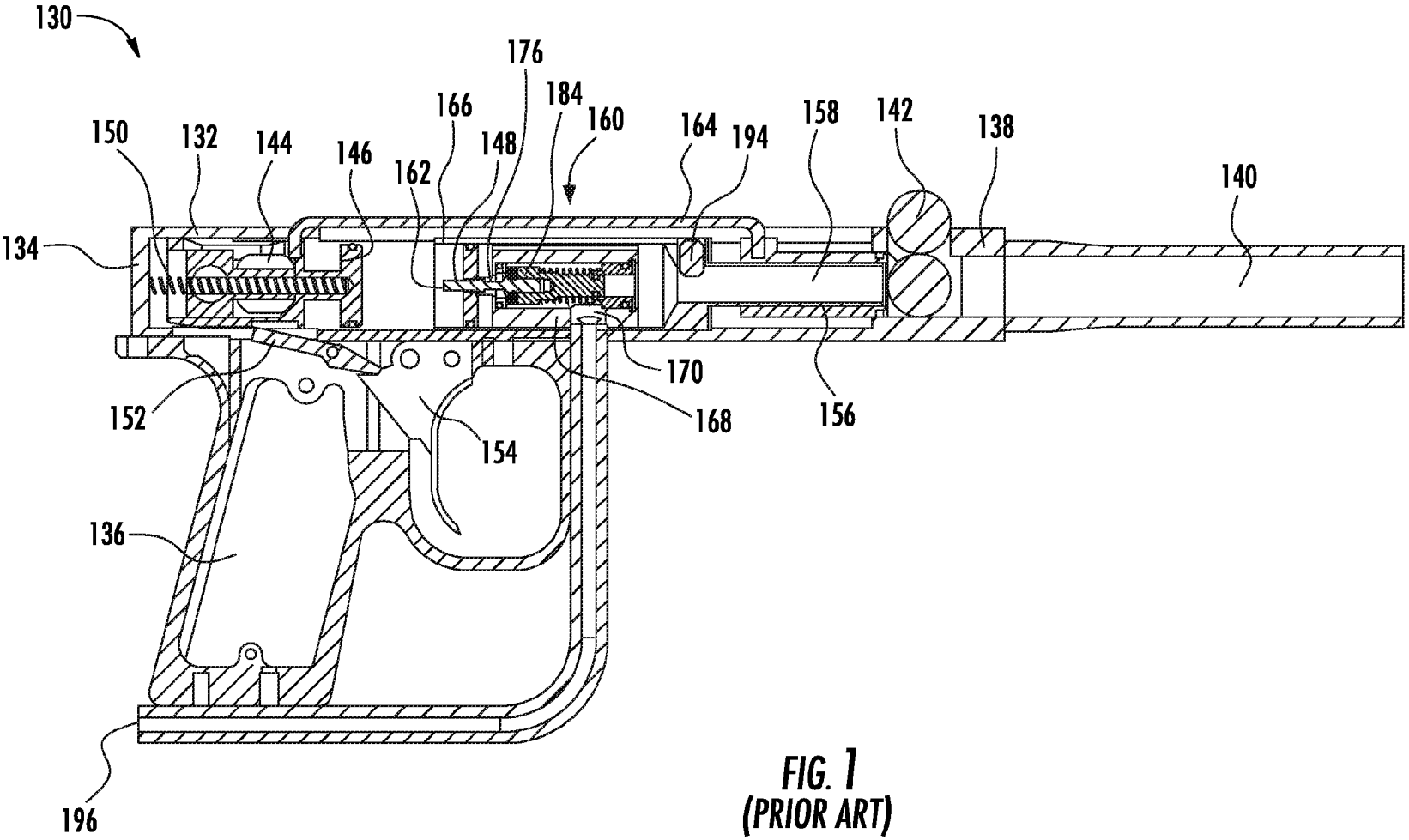
FIG. 1 (PRIOR ART)
FIG. 1 shows an exemplary prior art paintball gun.

The paintball gun of FIG. 1 may further include a front or foregrip 43, a bottom line adapter 85 for receiving a portion of a compressed gas supply such as a compressed gas tank, a gas line 49 for transmitting compressed gas from a source of compressed gas such as a compressed gas tank to components of the paintball gun, a trigger 53, grip frame 63 including a grip 62, and a trigger guard 68.

A forward body projection 79 extends adjacent the forward end 75 of the upper portion 77 of the body 39, having a first side 86*a* on one side of the body 39 and a second side 87*a* on the other side of the gun body. Each of the first side 86*a* and second side 87*b* has holes 88*a* therethrough.

A rearward body projection 89 extends adjacent the rearward end 76 of the upper portion 77, having a first side 86*b* on one side of the body 39 and a second side 87*b* on the other side of the gun body with each of the first side 86*b* and second side 87*b* having holes 88*b* therethrough. The front body projection 79 and rear body projection 89 may have a generally U-shaped cross section, having open bottoms, as shown, for example, in FIGS. 6, 10, 11B, 12, and 13. The front body projection 79 and rear body projection 89 are configured to receive at least a portion of the lower portion 77 when the paintball gun is in the closed position, as shown for example in FIGS. 2, 3, 4, and 6.

The lower portion 78 includes holes 200*a* corresponding to the holes 88*a* in the forward body projection 79. The lower portion 78 further includes holes 200*b* corresponding to the holes 88*b* in the rearward body projection 89. When the paintball gun is in a closed or assembled position, the holes 200*a* adjacent the forward end 75 of the lower portion 78 are aligned with the holes 88*a* in the front body projection 79, and the holes 200*b* adjacent the rear end 76 of the lower body portion 78 are aligned with the holes 88*b* in the rear body projection 89.

Figure 6:
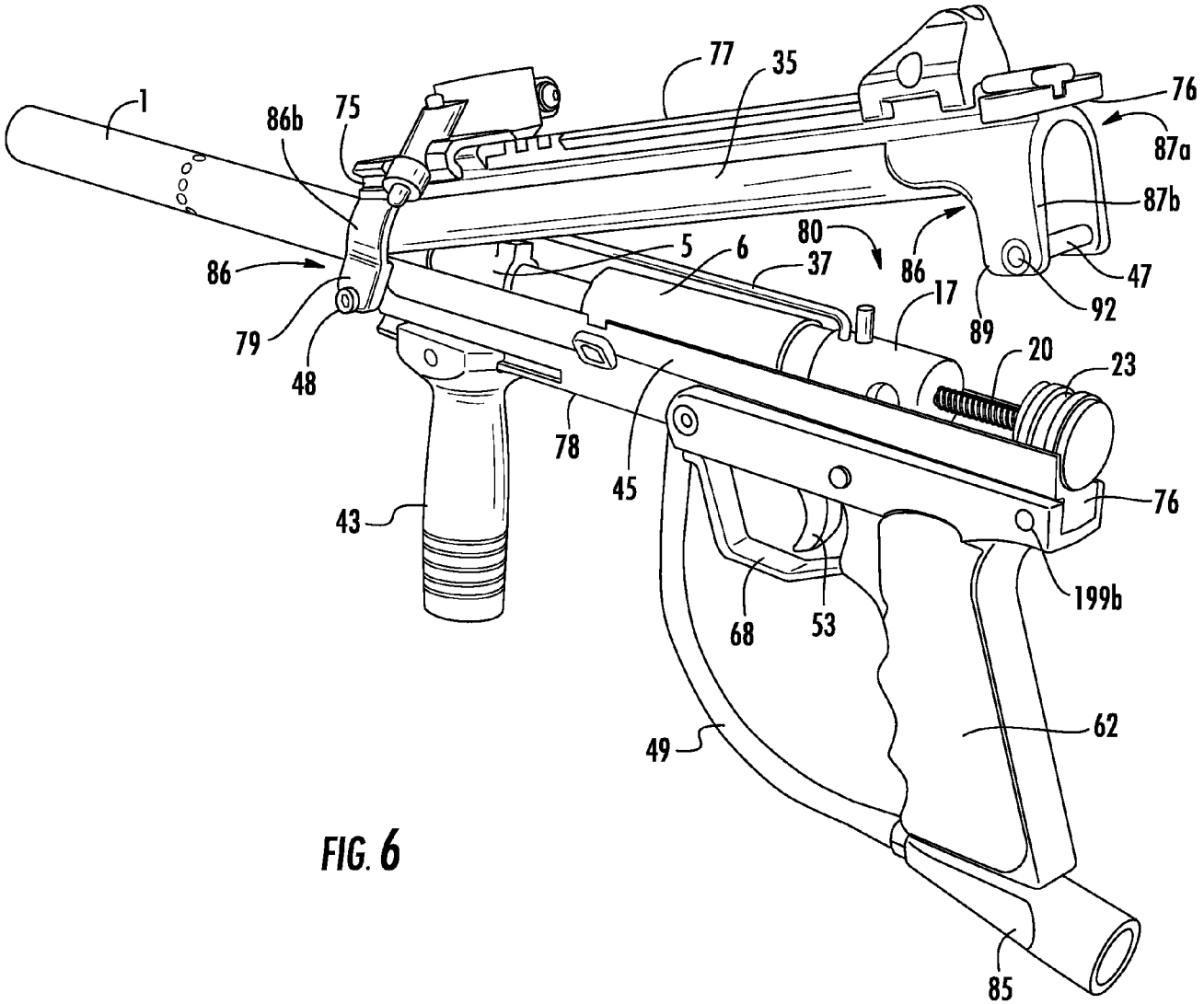
FIG. 6 shows a paintball gun according to an embodiment of the invention showing an example of a split body with exposed internal components.
Figure 11A:
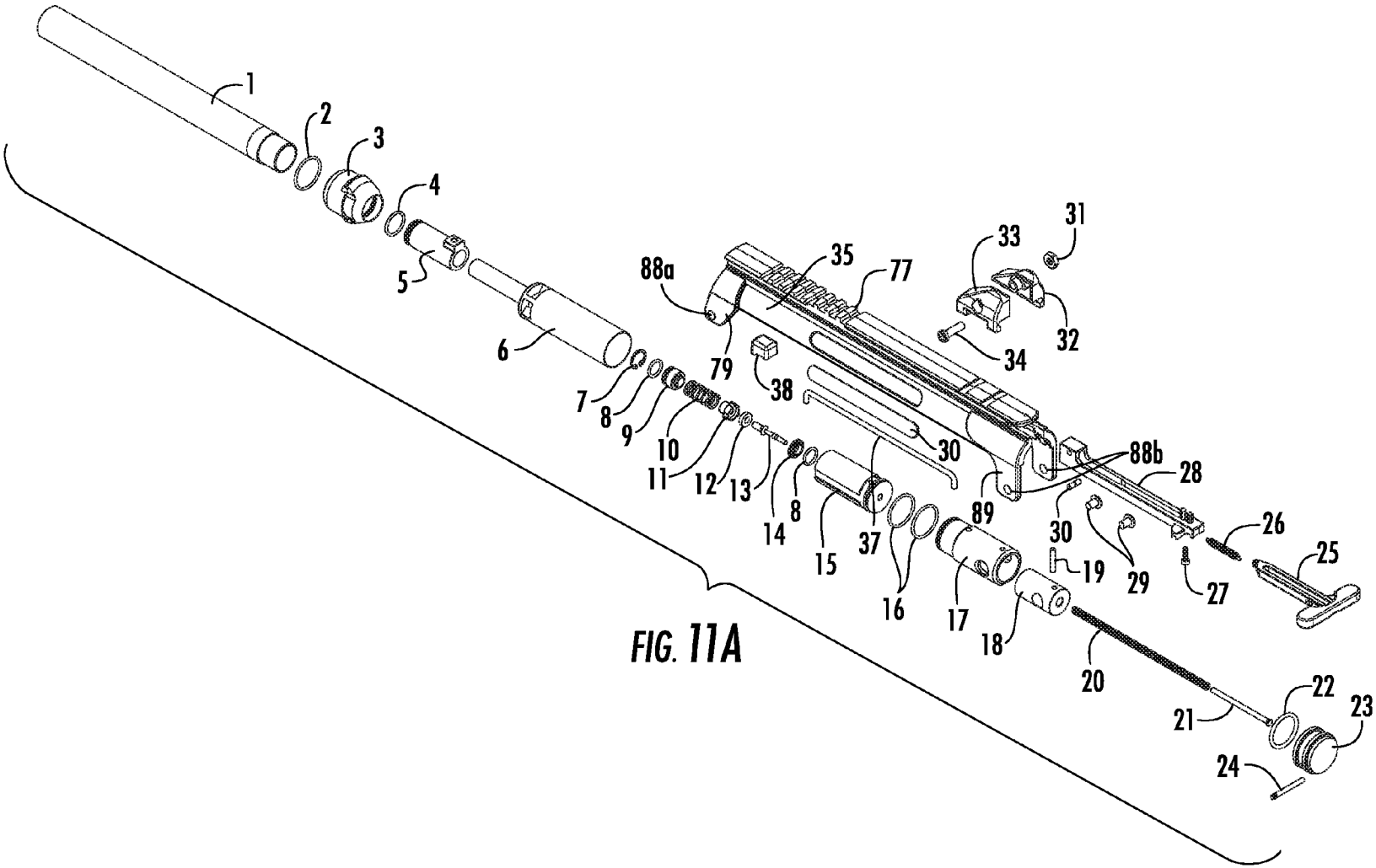
FIG. 11A shows a paintball gun according to an embodiment of the invention listing showing various component parts.
Figure 11B:
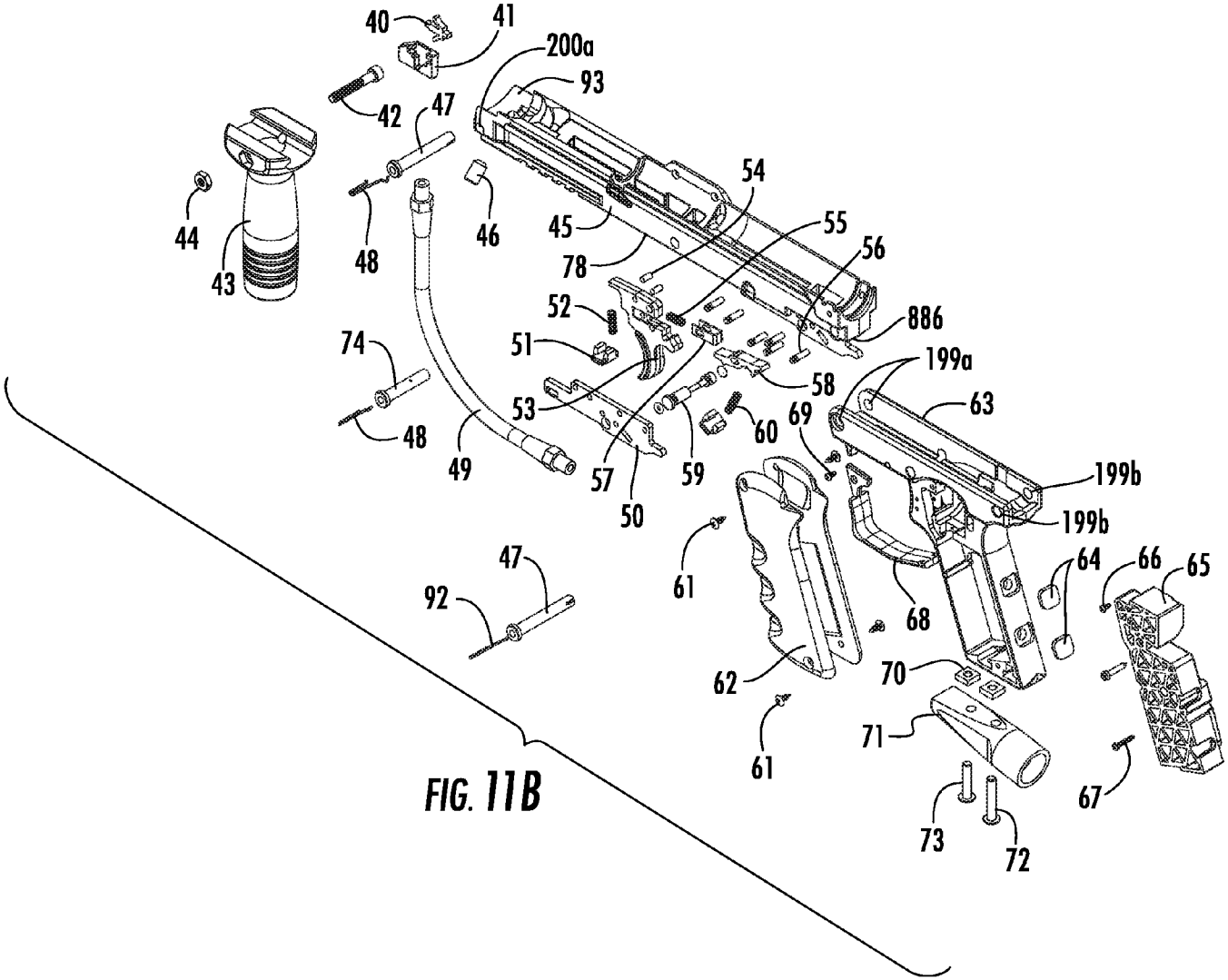
FIG. 11B shows a paintball gun according to an embodiment of the invention listing showing various component parts.

The lower body portion 78 is preferably attached to the grip frame 63, and may be received in and partially fit in a space at the top of the grip frame 63 configured to receive a part of the lower body portion 78, as shown, for example, in at least FIGS. 6 and 11B. The grip frame 63 preferably includes holes 199*b* corresponding to the holes 200*b* adjacent the rear end 76 of the lower body portion 78, and the holes 88*b* in the rear body projection 89, when the paintball gun is assembled. The grip frame 63 may also include holes 199*a* adjacent a forward end of the grip frame.

A split line 90 runs generally along or near the middle of the body 39 where the upper portion 77 and lower portion 78 meet when the body 39 is assembled.

The upper portion 77 is preferably secured to the lower portion 78 adjacent the forward end 75 by a pin which may be designated as a front body pin 48 extending through holes 88*a* in the first side 86*a* and second side 87*a* of the forward body projection 79, and the holes 200*a* adjacent the forward end 75. The upper portion 77 may be secured to the lower portion 78 (and also may be secured to the grip frame 63) adjacent the rearward end 76 by a rear pin 92 extending through holes 88*b* in the first side 86*b* and second side 87*b* of the rearward body projection 89, the holes 200*b* adjacent the rearward end 76 of the lower body 78 and the corresponding holes 199*b* in the rear grip frame 63.

The pin 48 preferably acts as a hinge 82 about which the upper body portion 77 and lower body portion 79 can move relative to each other. Accordingly, the body shell top 35 may be hingedly connected to body shell bottom 45 by the pin 92 through the forward body projection 79 to form a hinge 82, and the body shell top 35 is movable relative to body shell bottom 45 to form an open or disassembled, or closed or assembled, position of the body 39. Preferably, the body shell top 35 and body shell bottom 45 pivot about hinge 82, as shown in the Figures and described in greater herein. The pins 48, 92 are preferably quick-release type pins or may be other quick-release fasteners as are known in the art. The pins may be, for example, spring-loaded pins, detent pins, push-pull pins, pin with spring clip, push pins, pull-pins, clevis pin, cotter pins, combinations of the foregoing, or any other similar quick release attachments which those of skill in the art will readily appreciate.

The use of quick release pins allows for opening of the body 39 is a very simple and easy manner. Removing just a single pin (rear pin 92), which may be without the use of any tools, allows the body 39 to be moved to an open position for access or service. No other latches, screws or other types of attachments must be removed in order to open the body 39. Thus, the body may be opened in just one or two steps: removal of the pin 92, and moving, rotating and/or pivoting the upper portion 77 about the hinge 82 relative to the lower portion 78.

The forward end of the grip frame 63 also may be attached to the lower portion 78 by a forward grip frame pin 201*a* which may extend through grip frame hole 199*a* and corresponding holes in the lower portion 78.

A feed port or feed neck 91 is shown adjacent the forward end 75 of the upper portion 77 for receiving a paintball loader or "hopper" as in known in the art. This feed port 91 connects to the feed outtake port of paintball loader or "hopper," and paintballs are fed into the breech of the paintball marker accordingly.

Figure 3:
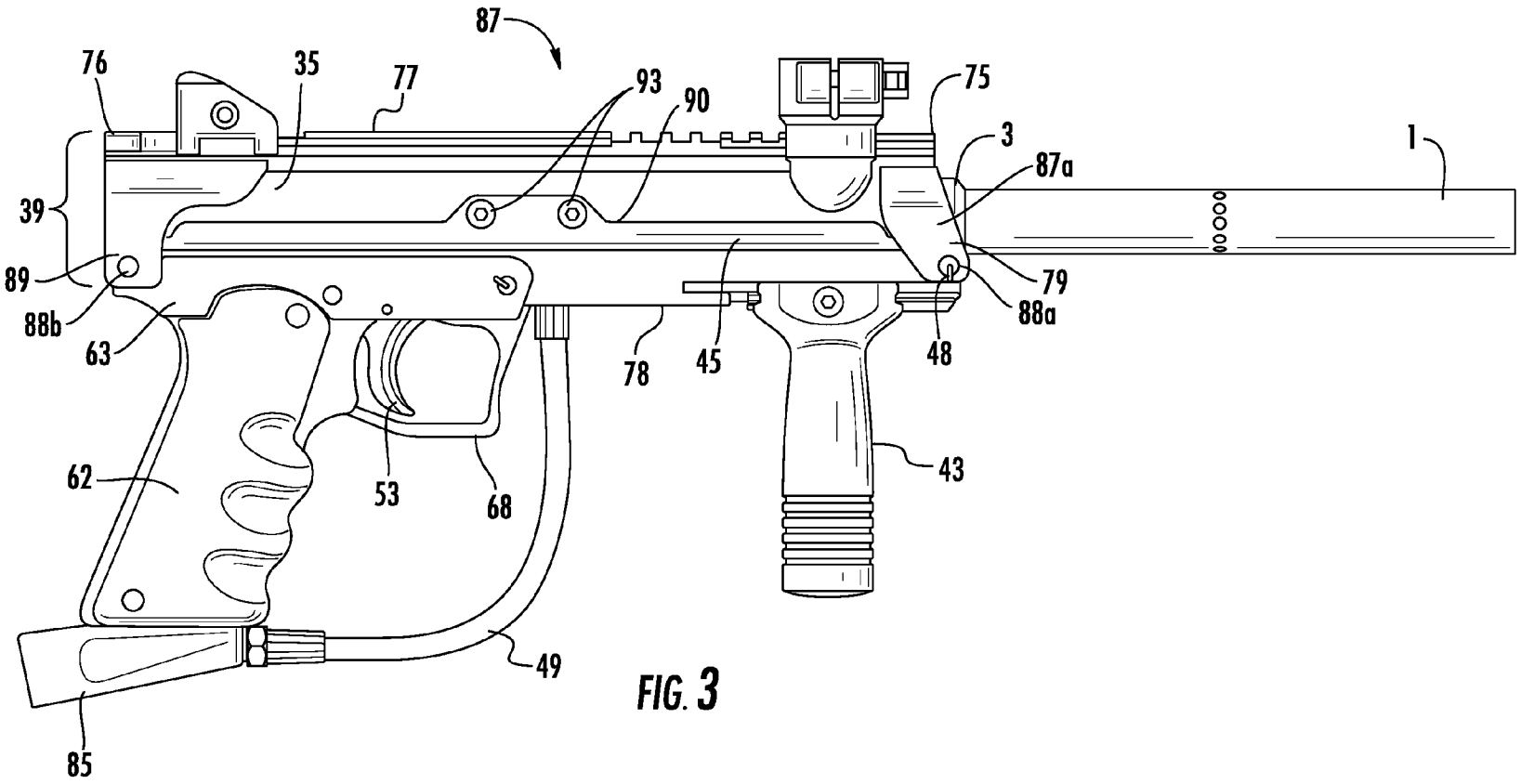
FIG. 3 shows a paintball gun according to an embodiment of the invention of FIG. 2, from the right side.
Figure 4:
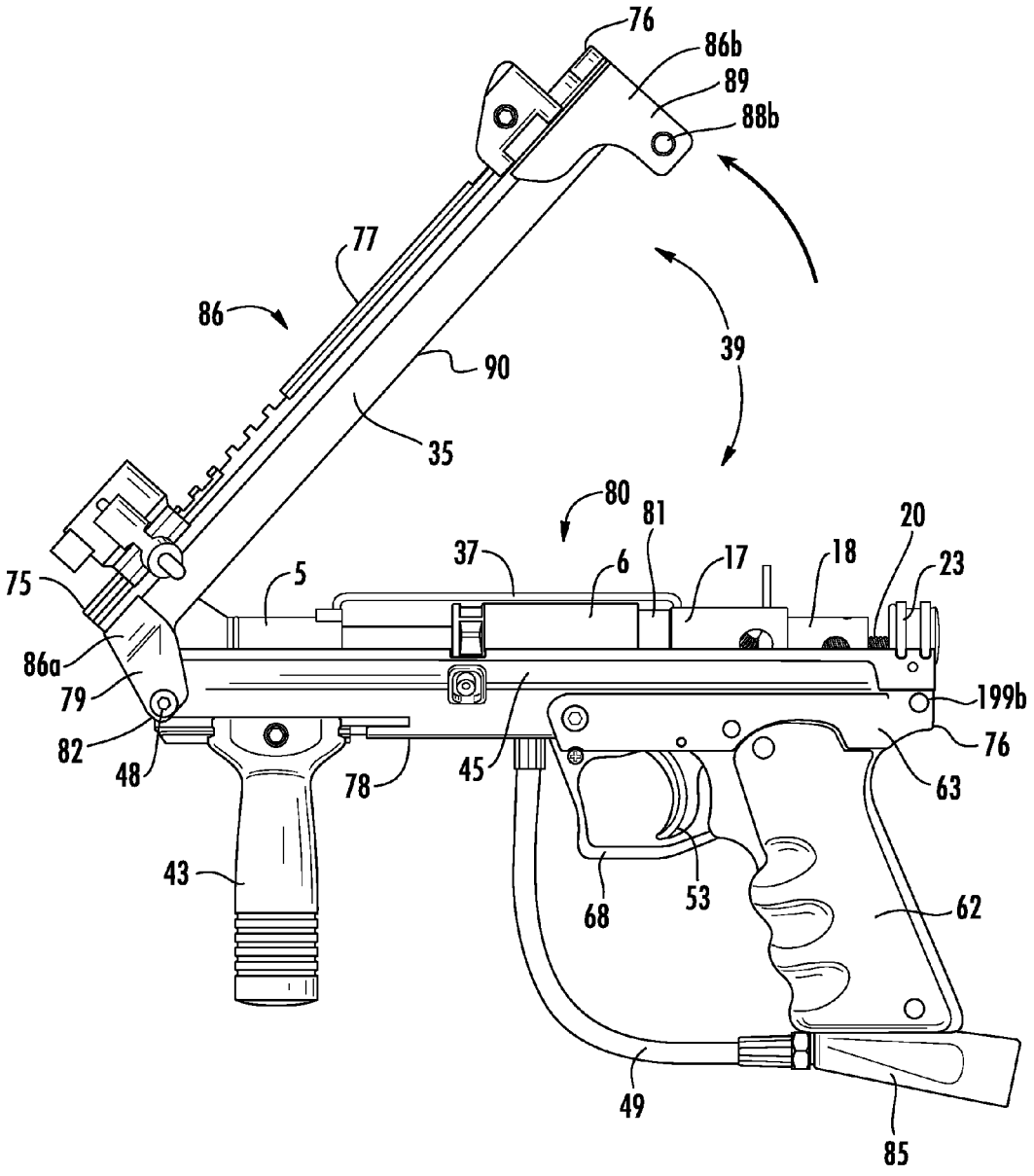
FIG. 4 shows a paintball gun according to an embodiment of the invention showing an example of a split paintball gun body with an upper portion and a lower portion.

FIG. 3 shows the right side (with the barrel 1 facing right) of the paintball gun of FIG. 2. FIGS. 2 and 3 show the paintball gun body 39 in what may be referred to as a closed or assembled position.

At least FIGS. 3, 4, 6, 7, and 10 show an embodiment of a paintball gun of the present invention, with the upper portion 77 and lower portion 78 moved away from each other, which may be referred to herein as an open, split or disassembled position. In order for the paintball gun body 39 to be in the open position shown in FIGS. 4, 6, 7, and 10, the rear pin 92 must be removed. As shown in at least FIGS. 4, 6, 7, and 10, movement of the body portions 77, 78 relative to each other, and in particular, rotational or pivotal movement of the upper portion 77 about hinge 82, exposes an internal portion or interior area 197 of the paintball gun, including the breech 198, with part of the internal components exposed, including a firing assembly 80. The body shell top 35 is split from the body shell bottom 45 along the split line 90, such that upper portion 77 includes body shell top 35 and lower portion 78 includes body shell bottom 45. The body shell top 35 and body shell bottom 45 are preferably sized and shaped having walls to accommodate the firing mechanism/assembly components within the internal area of the body 39. As shown in at least FIG. 6, the grip frame 63 may remain secured to and/or move along with the lower portion 78 when the body 39 is in the open position.

The firing assembly 80 preferably includes a front bolt 5, a power tube 6 about which the front bolt 5 is positioned, a rear bolt 17, a bolt plug 18, a drive spring 20, an end cap 23, a linkage arm 37, and a valve assembly 81. In operation, when the trigger 53 is actuated, the drive spring 20 will provide a force to bias the rear bolt 17 forward to contact the valve assembly 81. Since the front bolt 5 is connected to the rear bolt 17 by a linkage arm 37, the front bolt 5 will also be biased forward to chamber a paintball. When the rear bolt 15 contacts the valve assembly 81, compressed gas is released (such as supplied to the paintball gun by a compressed gas tank), and a projectile is fired from the paintball gun. Movement of the upper portion 77 relative to the lower portion 78 exposes the firing mechanism 80 of the paintball gun for field stripping, adjustments, service, or any maintenance.

As described, the body 39 is split horizontally along a substantially central longitudinal axis into the upper portion 77 and the lower portion 78. The upper portion 77 is attached at its forward end 75 to the lower portion 78 by the hinge 82 positioned adjacent the forward end 75 of the body 39. The upper portion 77 and lower portion 78 generally each form approximately about one-half of the body 39.

In a preferred embodiment of the present invention, the valve assembly 81 is preferably fixedly secured to the lower portion 78 within the body shell bottom 45. At least portions of the valve assembly 81 are configured to remain secured to the lower portion 78 when the upper portion 77 and lower portion 78 are moved away from each other. It is preferred that at least parts of the valve assembly 81 and the lower portion 78/body shell bottom 45 are firmly secured together so that they do not move relative to each other when the body 39 is in the open position. Moreover, the valve assembly 81 should remain in place unless a user completely disassembles that component, if it can be disassembled at all. For example, securing bolts 93 shown in FIGS. 3, 8, and 9 may be provided extending through the lower portion 78 and/or the body shell bottom 45 and the valve body 15 or other portions of the valve assembly 81 to fixedly secure at least parts of the valve assembly 81 to the lower portion 78 within the body shell bottom 45. The valve assembly 81 would thus not move unless the securing bolts 93 are removed. It may be that a user may move the body 39 to an open position while a compressed gas tank is still connected to the paintball gun, and therefore, compressed gas may flow into the valve assembly 81 when the paintball gun is in the open position. In such a situation, the valve assembly 81 should be secured to the lower portion 78 with enough strength to overcome the force of compressed gas providing a force to move the valve assembly 81 away from the lower portion 78/bottom body shell 45. The valve assembly 81 may be secured in any manner that maintains the valve assembly 81 in place securely connected to the lower portion 77/body shell bottom 45 when a source of compressed gas is attached to the gun. The valve assembly 81 may be, for example, bolted to the lower portion 77/body shell bottom 45 as shown, glued to the lower portion 77/body shell bottom 45, molded integrally with the lower portion 77/body shell bottom 45, or other arrangements would those of skill in the art would appreciate.

Figure 5:
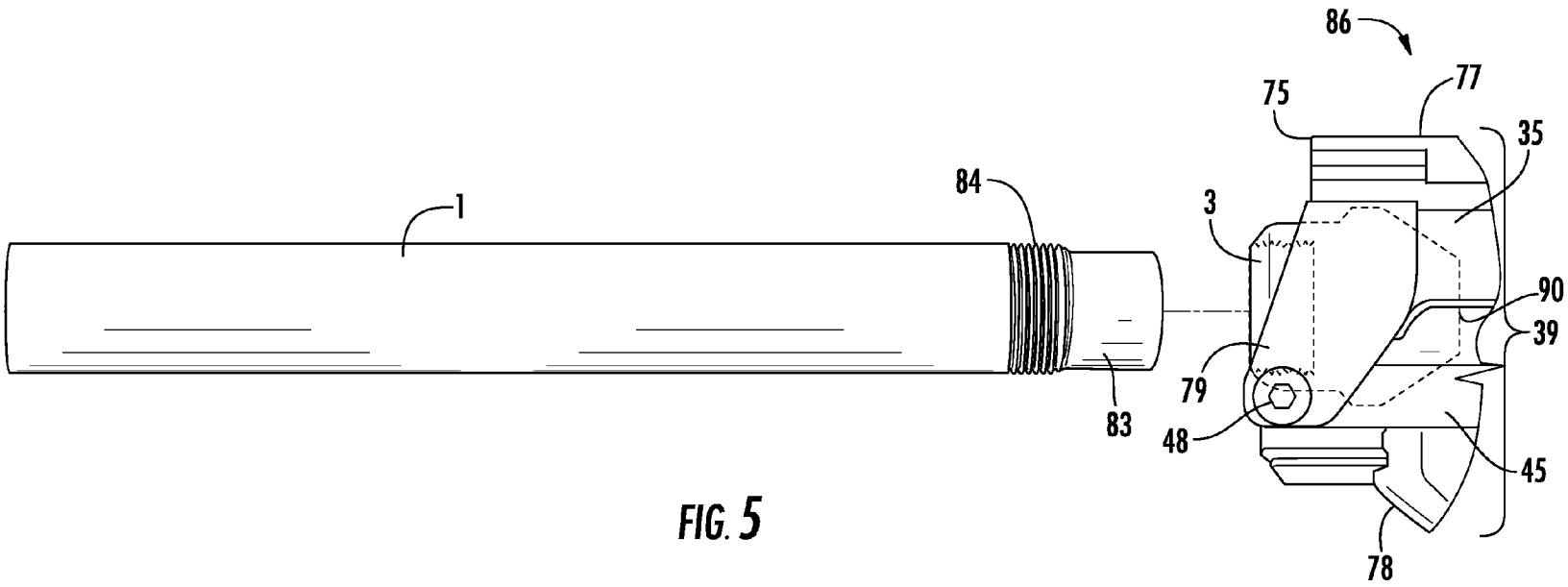
FIG. 5 shows a paintball gun according to an embodiment of the invention showing an example of a barrel and a barrel adaptor configuration.
Figure 7:
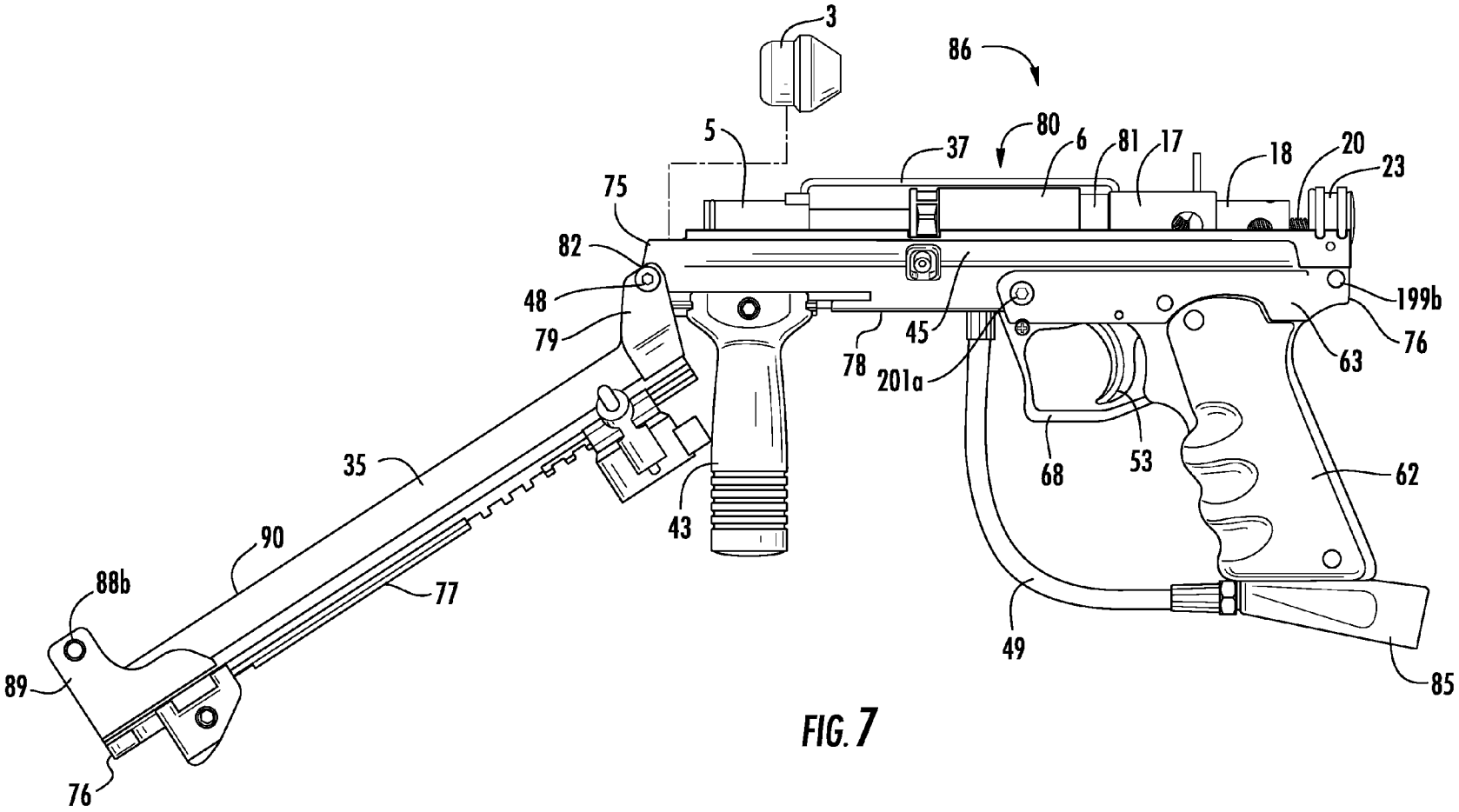
FIG. 7 shows a paintball gun according to an embodiment of the invention showing an example of a split body with exposed internal components.
Figure 8:
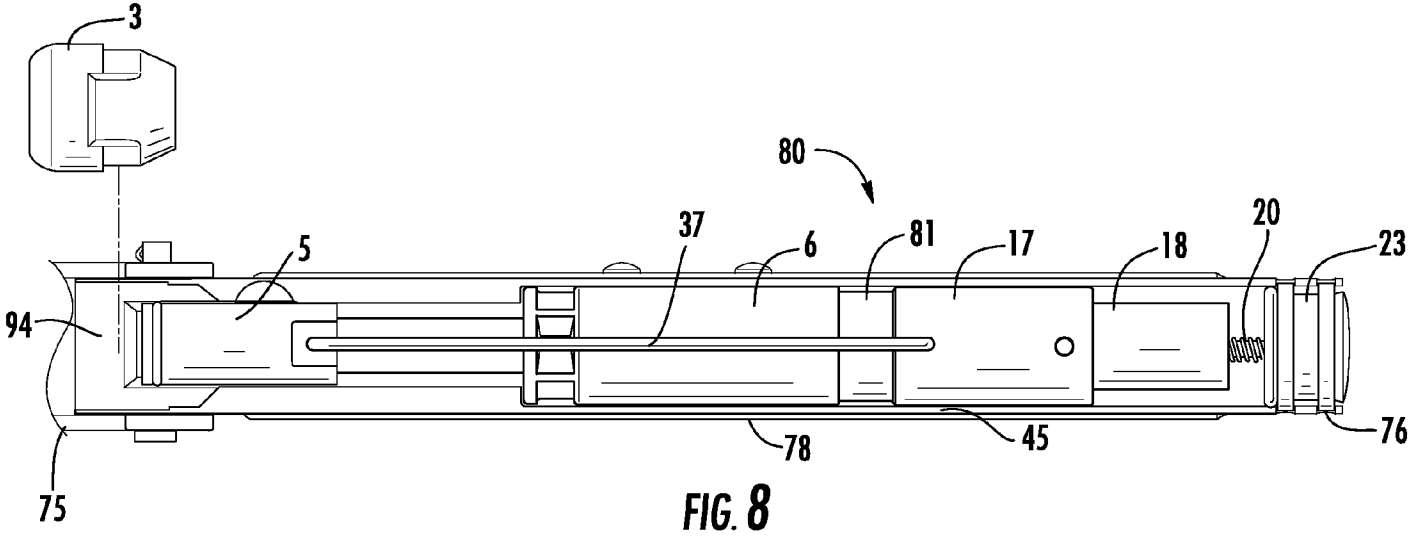
FIG. 8 shows a paintball gun according to an embodiment of the invention showing a top view of some of the internal components, with the body open.
Figure 9:
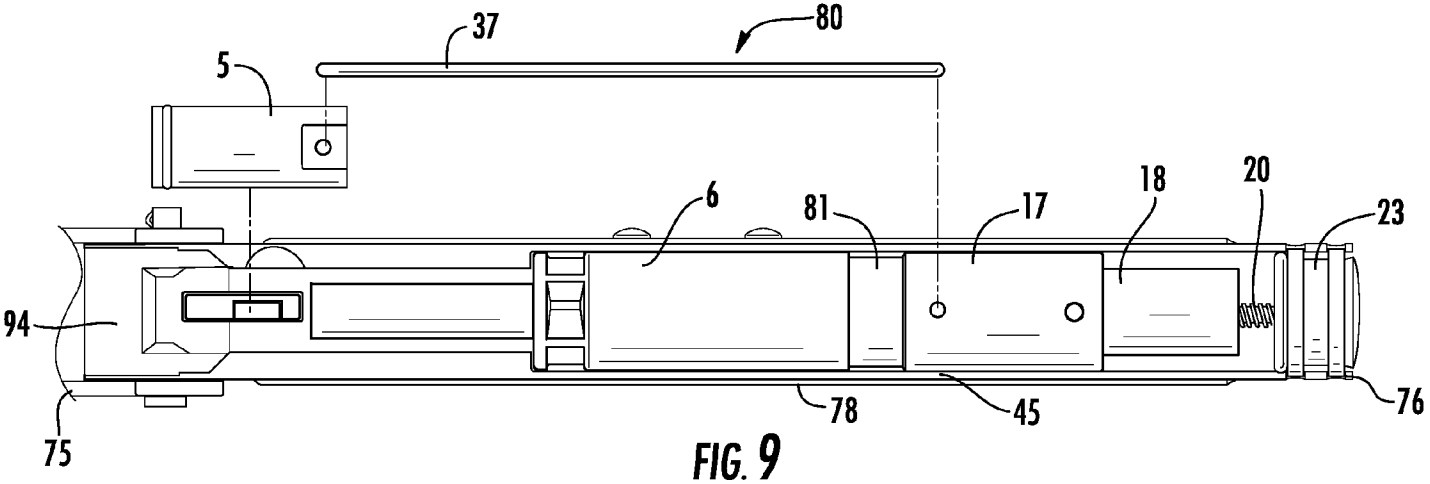
FIG. 9 shows a paintball gun according to an embodiment of the invention showing another top view of some of the internal components, with the body open.

In an embodiment of the present invention, the barrel 1 is connected to or otherwise secured to the body 39 of the paintball gun with a barrel adapter 3, as shown in at least FIGS. 5, 7, 8, and 10. Barrel 1 includes breach end 83 extending from barrel 1 and barrel threads 84. The barrel adapter 3 preferably includes a threaded opening that threadedly engages the barrel threads 84, as shown for example in at least FIGS. 5, 7, 8, and 10. The barrel adapter 3 is positioned within the body 39 adjacent the forward end 75 of the body 39, in front of the front bolt 37. As shown in FIG. 5, when the body 39 is in the closed position, the upper portion 77 and lower portion 78 clamp down on the barrel adapter 3 to hold the barrel adapter 3 and barrel 1 in place. Preferably, the inner walls of the body shell top 35 and body shell bottom 45 include recesses 93, as shown in FIGS. 8 and 9, which are shaped and sized to accommodate, hold and/or support the barrel adapter 3. Preferably, when the front bolt 37 is in a forward or firing position, the front bolt contacts the rearwardly facing portion of the barrel adapter 3, and preferably provides a sealed area for compressed gas to act upon a projectile that has been chambered by the bolt.

Figure 10:
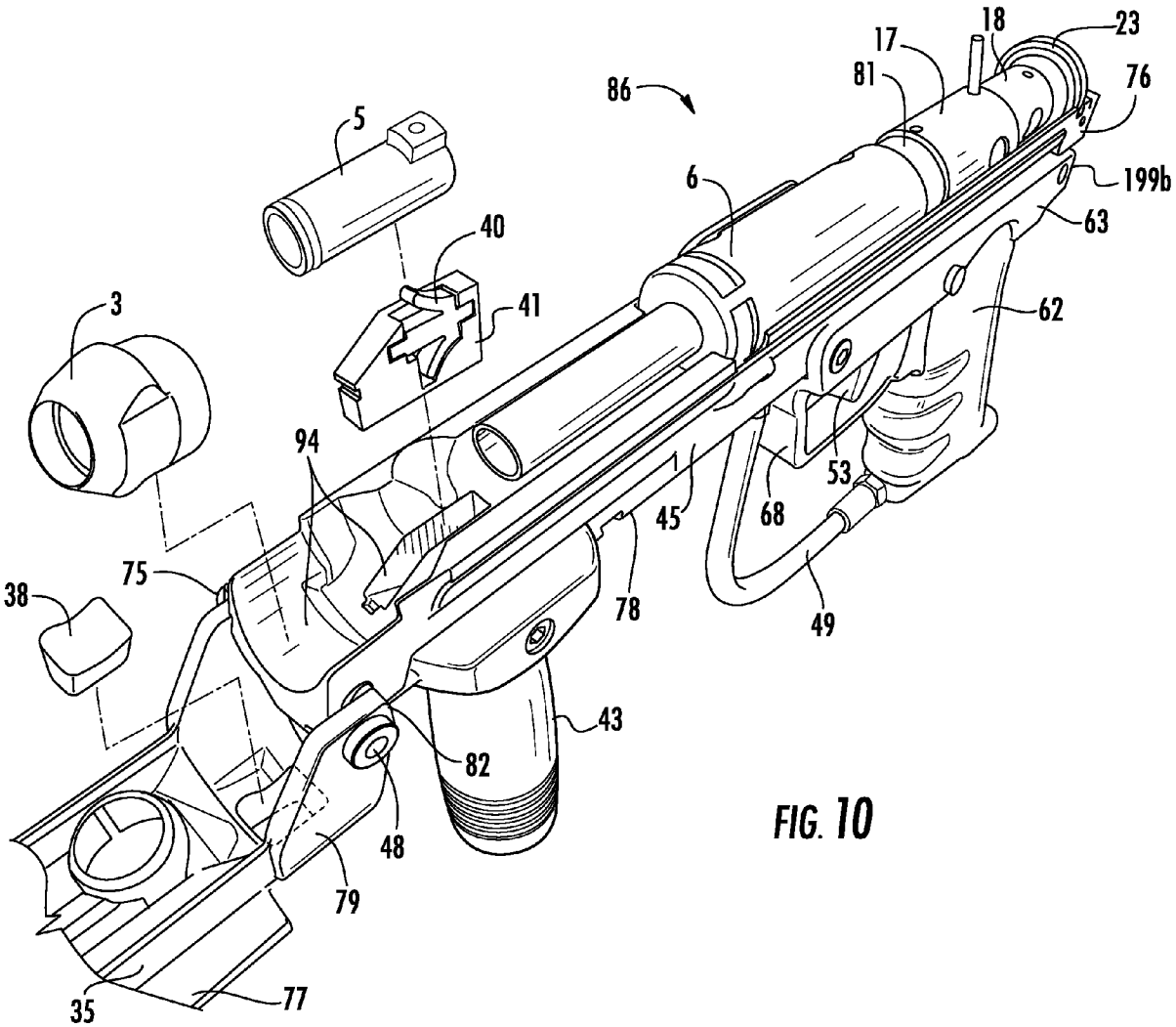
FIG. 10 shows a paintball gun according to an embodiment of the invention showing an expanded view of the internal components.
Figure 12:
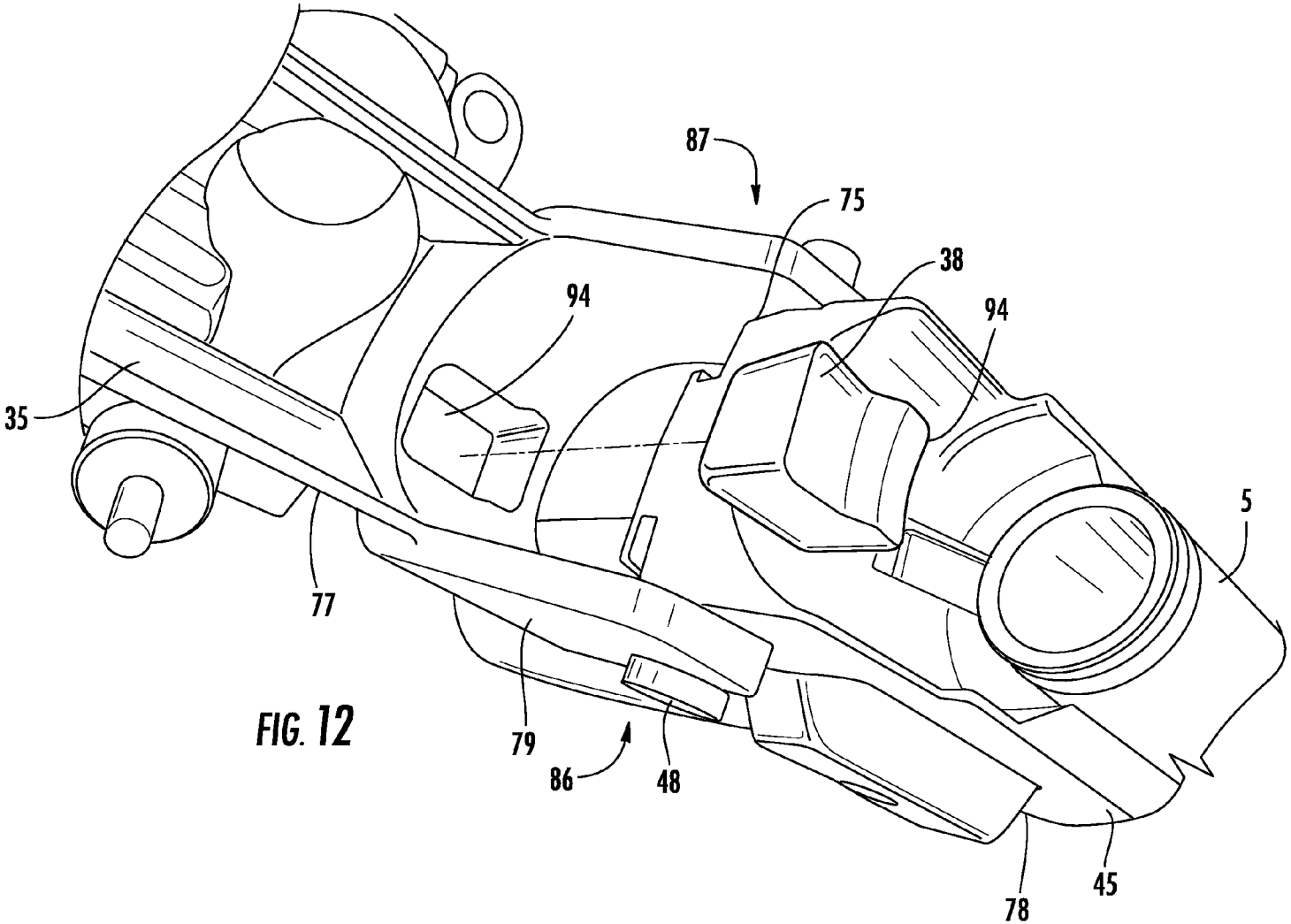
FIG. 12 shows a paintball gun according to an embodiment of the invention showing a barrel gripping piece.

As can be appreciated, when using a paintball gun, it is important that the barrel is tightly secured and does not move or wobble relative to the body 39, so that the paintball gun fires accurately and the projectile travels through the barrel without disruption. In addition, when a moveably body of a paintball gun is provided, such as in the present invention, the body portions may not come together as tightly to clamp the barrel adapter 3 after continued use. Accordingly, to assist in securing the barrel adapter 3 in place and ensure a tight fit so that the barrel 1 does not move or otherwise wobble, a barrel gripping piece 38 is provided, as shown in at least FIGS. 10 and 12. The barrel gripping piece 38 preferably comprises a piece of elastic, flexible plastic, rubber or other material that acts to positively secure the barrel adapter 3 in place by, for example, a friction fit when the body 39 is in a closed position. A recess 94 is preferably provided positioned on the inner surface 95 of one of the lower portion 77 or the upper portion 78 adjacent to the forward end 78 of the paintball gun. FIGS. 10 and 12 show the recess 94 in greater detail formed in the upper portion 77 of the body 39. The barrel gripping piece 38 is configured to mate with the recess 94. The barrel gripping piece 38 holds the barrel adaptor 3 in place between the upper portion 77 and the lower portion 78 when the body 39 is in a closed position, and provides an additional means for securing the barrel adapter 3 in place. Preferably, the barrel gripping piece 38 has a contoured outer wall 96, designed to engage the contour of an outer wall of the barrel adapter 3. Preferably, the barrel gripping piece 38 has some give or play so that it may frictionally secure the barrel 1 in place. The barrel gripping piece may be positioned in a recess in either the upper portion 77 or lower portion 78, and multiple gripping pieces and recesses may also be provided.

FIGS. 6 and 7 show the body 39 in two different open positions. In FIG. 6, the barrel 1 is still engaged to the barrel adapter 3. The upper portion 77 can move about 45 degrees in this position. In FIG. 7, the barrel 1 has been detached, and the upper portion 7 can rotate about 270 degrees. Thus, a user working on maintenance of a paintball gun according to the present invention has various access options for accessing the internal components.

As can be appreciated from, for example, at least FIGS. 4, 7, 8, and 9, when the body 39 is in an open position, in an embodiment of the present invention, the top portions of the internal components can be exposed, observed, serviced and/or accessed. For example, in FIGS. 4 and 7, moving the upper portion 77 of the body 39 exposes approximately at least about the top halves or upper portions of the front bolt 5, valve assembly 81, rear bolt 17, rear bolt plug 18 and drive spring 20. Thus, the internal components can be readily seen and are readily accessible.

FIG. 8 shows a top view of the interior area 197 and internal components when the upper portion 77 has been more fully rotated to an open position, such as in FIGS. 7 and 10. The barrel adaptor 3, body shell bottom 45, forward end 75, rearward end 76, lower portion 78 and firing assembly 80 with front bolt 5, power tube 6, rear bolt 17, bolt plug 18, drive spring 20, end cap 23, linkage arm 37, and valve assembly 81 may be easily seen and accessed. FIG. 8 shows the barrel adapter 3 disassembled from the lower portion 75, and the other internal components can be removed and/or serviced as well. FIG. 9 also shows a top view of interior are 197 and internal components when the upper portion 77 has been more fully rotated to an open position, such as in FIGS. 7 and 10, with the front bolt 5 and linkage arm 37 removed.

FIG. 10 shows a view of a paintball gun according to the present invention from the front left, showing the upper portion 77 being more fully rotated to an open position, with the barrel 1 removed. Removal of the front bolt 5 from the body shell bottom 45 exposes a detent 40 held in a detent shell 41, that is received in a recess 94 in the body shell bottom 45, which also may be readily accessed and serviced.

FIG. 11A shows components of an embodiment of a paintball gun of the present invention, that may include a barrel 1, barrel o-ring 2, barrel adaptor 3, front bolt o-ring 4, front bolt 5, power tube 6, valve snap ring 7, internal valve o-ring 8, front valve seat 9, valve spring 10, plunger cup 11, cup seal 12, valve stem 13, rear valve seat 14, valve body 15, valve and bolt o-ring 16, rear bolt 17, bolt plug 18, dowel pin 19, drive spring 20, drive spring pin 21, shock absorber o-ring 22, end cap 23, dowel pin 24, handle cocking 25, spring ext 26, screw 27, cover handle spring 28, valve lock screw 29, pin spring 30, nut receiver 31, sight rear RH 32, sight rear LH 33, long receiver bolt 34, body shell top 35, logo 36, linkage arm 37, and support barrel adaptor top 38.

FIG. 11B shows components of an embodiment of a paintball gun of the present invention, that may include a detent 40, detent shell 41, screw 42, front grip 43, nut receiver 44, body shell bottom 45, velocity screw 46, pin spring front pivot 47, front body pin 48, gas line 49, trigger plate 50, trigger plate spacer 51, trigger plate return spring 52, trigger 53, trigger pin 54, trigger slide spring 55, trigger plate dowel pin 56, trigger slide 57, sear 58, safety with o-ring 59, sear spring 60, screw 61, grip 62, frame 63, plug grip frame 64, grip support mechanic 65, screw 66, screw 67, trigger guard 68, trigger guard grip screw 69, ASA nut 70, ASA adaptor 71, long ASA bolt 72, short ASA bolt 73, and pin spring front grip 74. Any combination of the components shown in FIGS. 11A and 11B may be used as part of a paintball gun of the present invention having a split body.

Figure 13:
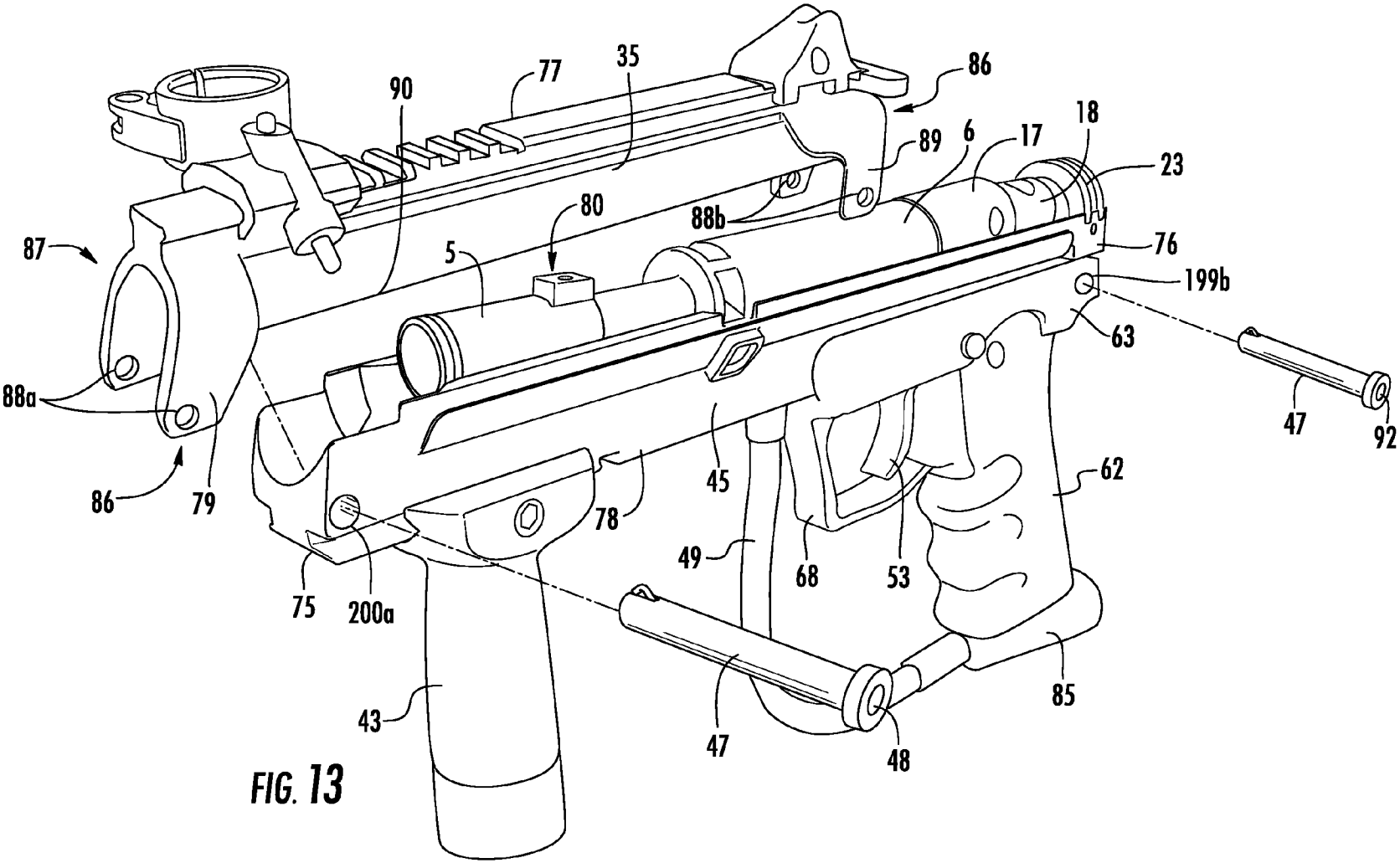
FIG. 13 shows a paintball gun according to an embodiment of the invention showing an example of a split body.

In addition to the capability of rotating the upper portion 77 of the body 39 relative to the lower portion 78 of the body 39 about the hinge 82, the entire upper portion 77 also may be removed. Accordingly, as shown in FIG. 13, removing both the front body pin 48 and also the rear pin 92 may allow a user to completely remove the upper portion 77. The grip frame 63 may also be completely removed by removing the respective pins.

It is preferred that one or both of the pins 48, 92 are removable without the use of tools, and such a design is designated herein as "tool-less." Thus, a user (e.g., paintball sport player or person performing maintenance on a paintball gun) may readily field strip the paintball gun of the present invention, without having to carry a set of tools with them, or without having to use a tool. The user may simply extract or otherwise push out, for example, front body pin 48, and the body 39 may be opened. As shown for example in FIG. 13, front body pin 48 may be a spring pin which may be removed without tools. Alternately, only one or a few tools (e.g., screwdriver) or other implements (e.g., a key) might be needed to remove the pins 48, 92. In any case, the paintball marker may be easily disassembled and serviced.

Figure 14:
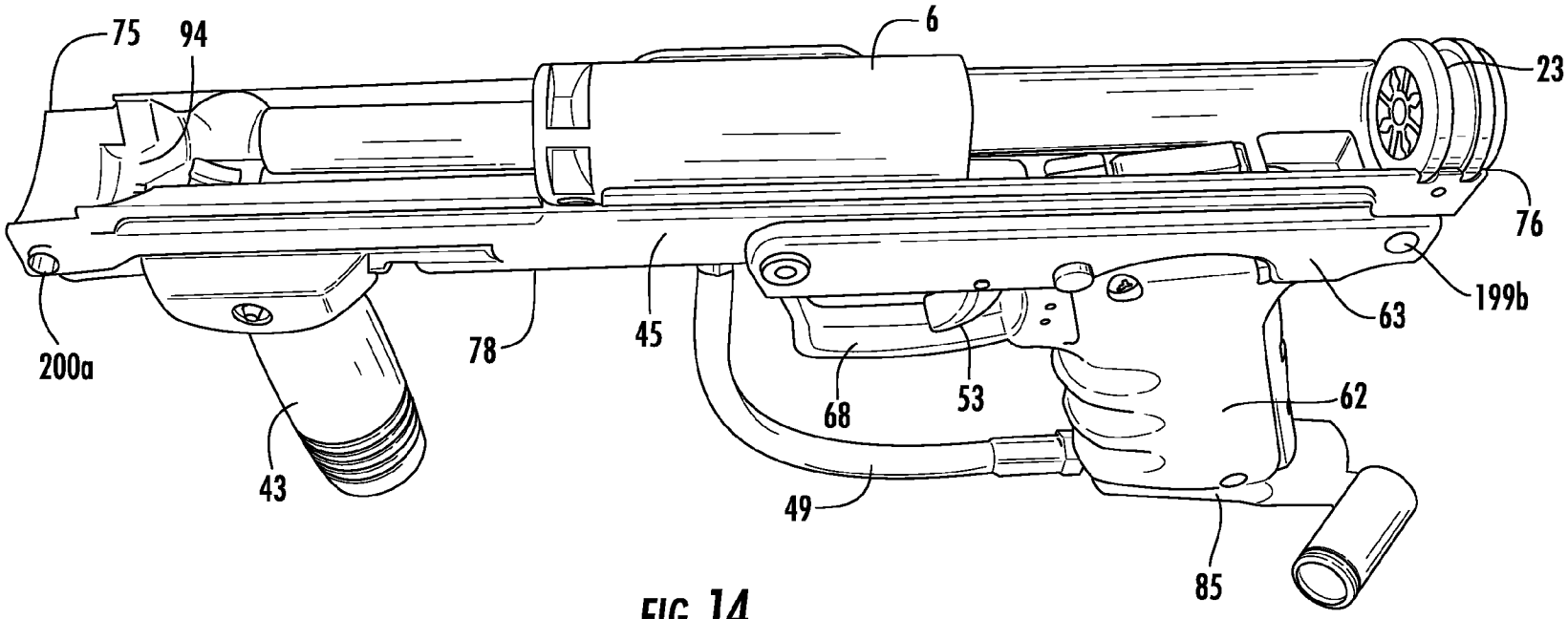
FIG. 14 shows a paintball gun according to an embodiment of the invention showing a top view of some of the internal components, with others removed.

FIG. 14 shows the lower portion 78 of the body 39, including the body shell bottom 45 with only the valve body 15 (which in an embodiment may have the power tube 6 integrally formed) in place. The other components of the firing assembly 80 have been removed. The valve body 15 remains in place, and is preferably secured to body shell bottom 45 by, for example, bolts.

A method of servicing a paintball gun according to an embodiment of the present invention, the method comprising the steps of providing a paintball gun with a body 39 having a body shell top 35 movable between an open position that provides access to at least portions of at least some of the internal components of the paintball gun, and a closed position that blocks access to at least portions of at least some of the internal components of the paintball gun, wherein the body shell top 35 may be secured in the closed position, releasing the body shell top 35 to allow movement towards the open position, and moving the body shell top 35 to the open position to expose at least portions of at least some of the internal components of the paintball gun.

It is understood that this invention is not limited to the particular embodiments disclosed, but is intended to cover all modifications and combinations which are within the spirit and scope of the invention as described herein and/or defined by the appended claims, and/or shown in the attached drawings.

What is claimed is:

1. A paintball gun comprising:

a body having a forward end and an interior area;

at least one movable portion of the body adjacent the forward end, the movable portion movable from a first position to a second position, wherein the first position is an open position, and wherein the second position is a closed position; and a barrel adapter, at least a portion of the barrel adapter configured to be secured within the interior area of the body adjacent the forward end, the barrel adapter configured to threadedly engage a threaded end of a paintball gun barrel;

the movable portion including a gripping piece configured to engage the barrel adapter when in the second position, wherein the gripping piece is configured to assist in securing the barrel adapter in place when the movable portion is in the second position.

2. The paintball gun of claim 1, wherein the gripping piece is flexible.

3. The paintball gun of claim 1, wherein the gripping piece includes a contoured portion conforming to a shape of a wall of the barrel adapter.

4. The paintball gun of claim 1, wherein the movable portion includes a recess and the gripping piece is removably positioned in the recess.

5. The paintball gun of claim 1, wherein the movable portion is connected by a hinge to at least one second portion of the body adjacent the forward end.

6. The paintball gun of claim 1, wherein the gripping piece is removable from the first movable portion.

7. A method of securing a barrel adapter configured to threadedly engage a threaded end of a paintball gun barrel in a body of a paintball gun, the body including a forward end, the method comprising:

moving a movable portion of the body to a first position, the movable portion including a gripping piece, wherein the first position is an open position allowing for positioning of the barrel adapter at least partially within an interior of the body;

positioning a barrel adapter adjacent the forward end of the body; and moving the movable portion of the body to a second position, wherein the second position is a closed position, wherein the gripping piece engages the barrel adapter in the second position, and wherein the gripping piece is configured to assist in securing the barrel adapter in place when the movable portion is in the second position.

8. The method of claim 7, wherein the gripping piece is flexible.

9. The method of claim 7, wherein the gripping piece includes a contoured portion conforming to a shape of an outer wall of the barrel adapter.

10. The method of claim 7, wherein the movable portion includes a recess and the gripping piece is removably positioned in the recess.

11. The method of claim 7, wherein the movable portion is connected by a hinge to at least a portion of the body adjacent the forward end.

12. The method of claim 7, wherein the gripping piece is removable from the movable portion.

* * * * *